US006415529B1

(12) United States Patent
Kelley

(10) Patent No.: US 6,415,529 B1
(45) Date of Patent: Jul. 9, 2002

(54) SHOE VENTILATION APPARATUS

(76) Inventor: Daniel D. Kelley, 634 Center St. East, Warren, OH (US) 44481

( * ) Notice: Subject to any disclaimer, the term of this patent is extended or adjusted under 35 U.S.C. 154(b) by 0 days.

(21) Appl. No.: 09/653,850

(22) Filed: Sep. 1, 2000

(51) Int. Cl.[7] ..... A43B 7/08

(52) U.S. Cl. ..... 36/3 R; 36/3 A; 36/3 B; 36/2.6

(58) Field of Search ..... 36/2.6, 3 R, 3 B, 36/3 A

(56) References Cited

U.S. PATENT DOCUMENTS

| | | | | |
|---|---|---|---|---|
| 2,190,802 | A | * | 2/1940 | Powell |
| 2,701,923 | A | * | 2/1955 | Toman |
| 3,029,530 | A | * | 4/1962 | Eaton |
| 3,060,599 | A | * | 10/1962 | Okuyama |
| 3,331,146 | A | * | 7/1967 | Karras |
| 4,845,338 | A | * | 7/1989 | Lakic |
| 5,341,581 | A | * | 8/1994 | Huang |
| 5,975,861 | A | * | 11/1999 | Shin et al. |

FOREIGN PATENT DOCUMENTS

| | | | |
|---|---|---|---|
| DE | 351517 | * | 4/1922 |
| FR | 2670369 | * | 6/1992 |
| WO | 8605663 | * | 10/1986 |
| WO | 9409661 | * | 5/1994 |

* cited by examiner

*Primary Examiner*—Ted Kavanaugh

(57) ABSTRACT

A shoe ventilation apparatus for effectively keeping the user's feet cool, dry and free from perspiration and odor. The shoe ventilation apparatus includes a shoe including a bottom sole, a heel portion, and an upper portion; and also includes a pocket securely attached to an exterior of the upper portion of the shoe; and further includes a bellows having an air-inlet port and an air-outlet port and being disposed in the heel portion; and also includes an air-intake conduit member having an air-inlet end which is securely attached to and extended into the pocket for receiving air from outside the shoe, and also having an air-outlet end which is securely connected to the air-inlet port of the bellows; and further includes air outtake conduit members having air-inlet ends connected to the air-outlet port of the bellows with the air outtake conduit members extending throughout the bottom sole of the shoe and also having air-outlet ends extending out of a top of the bottom sole for ventilating a user's foot disposed inside the shoe.

8 Claims, 2 Drawing Sheets

SHOE VENTILATION APPARATUS

BACKGROUND OF THE INVENTION

1. Field of the Invention

The present invention relates to a foot comfort system and more particularly pertains to a new shoe ventilation apparatus for effectively keeping the user's feet cool, dry and free from perspiration and odor.

2. Description of the Prior Art

The use of a foot comfort system is known in the prior art. More specifically, a foot comfort system heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,826,349; U.S. Pat. No. 5,813,140; U.S. Pat. No. 5,505,010; U.S. Pat. No. 1,660,698; U.S. Pat. No. 5,515,622; and U.S. Pat. No. Des. 388,941.

While these devices fulfill their respective, particular objectives and requirements, the aforementioned patents do not disclose a new shoe ventilation apparatus. The inventive device includes a shoe including a bottom sole, a heel portion, and an upper portion; and also includes a pocket securely attached to an exterior of the upper portion of the shoe; and further includes a bellows having an air-inlet port and an air-outlet port and being disposed in the heel portion; and also includes an air-intake conduit member having an air-inlet end which is securely attached to and extended into the pocket for receiving air from outside the shoe, and also having an air-outlet end which is securely connected to the air-inlet port of the bellows; and further includes air outtake conduit members having air-inlet ends connected to the air-outlet port of the bellows with the air outtake conduit members extending throughout the bottom sole of the shoe and also having air-outlet ends extending out of a top of the bottom sole for ventilating a user's foot disposed inside the shoe.

In these respects, the shoe ventilation apparatus according to the present invention substantially departs from the conventional concepts and designs of the prior art, and in so doing provides an apparatus primarily developed for the purpose of effectively keeping the user's feet cool, dry and free from perspiration and odor.

SUMMARY OF THE INVENTION

In view of the foregoing disadvantages inherent in the known types of foot comfort system now present in the prior art, the present invention provides a new shoe ventilation apparatus construction wherein the same can be utilized for effectively keeping the user's feet cool, dry and free from perspiration and odor.

The general purpose of the present invention, which will be described subsequently in greater detail, is to provide a new shoe ventilation apparatus which has many of the advantages of the foot comfort system mentioned heretofore and many novel features that result in a new shoe ventilation apparatus which is not anticipated, rendered obvious, suggested, or even implied by any of the prior art foot comfort system, either alone or in any combination thereof.

To attain this, the present invention generally comprises a shoe including a bottom sole, a heel portion, and an upper portion; and also includes a pocket securely attached to an exterior of the upper portion of the shoe; and further includes a bellows having an air-inlet port and an air-outlet port and being disposed in the heel portion; and also includes an air-intake conduit member having an air-inlet end which is securely attached to and extended into the pocket for receiving air from outside the shoe, and also having an air-outlet end which is securely connected to the air-inlet port of the bellows; and further includes air outtake conduit members having air-inlet ends connected to the air-outlet port of the bellows with the air outtake conduit members extending throughout the bottom sole of the shoe and also having air-outlet ends extending out of a top of the bottom sole for ventilating a user's foot disposed inside the shoe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shoe ventilation apparatus which has many of the advantages of the foot comfort system mentioned heretofore and many novel features that result in a new shoe ventilation apparatus which is not anticipated, rendered obvious, suggested, or even implied by any of the prior art foot comfort system, either alone or in any combination thereof.

It is another object of the present invention to provide a new shoe ventilation apparatus which may be easily and efficiently manufactured and marketed.

It is a further object of the present invention to provide a new shoe ventilation apparatus which is of a durable and reliable construction.

An even further object of the present invention is to provide a new shoe ventilation apparatus which is susceptible of a low cost of manufacture with regard to both materials and labor, and which accordingly is then susceptible of low prices of sale to the consuming public, thereby making such shoe ventilation apparatus economically available to the buying public.

Still yet another object of the present invention is to provide a new shoe ventilation apparatus which provides in the apparatuses and methods of the prior art some of the advantages thereof, while simultaneously overcoming some of the disadvantages normally associated therewith.

Still another object of the present invention is to provide a new shoe ventilation apparatus for effectively keeping the user's feet cool, dry and free from perspiration and odor.

Yet another object of the present invention is to provide a new shoe ventilation apparatus which includes a shoe including a bottom sole, a heel portion, and an upper portion; and also includes a pocket securely attached to an exterior of the upper portion of the shoe; and further includes a bellows having an air-inlet port and an air-outlet port and being disposed in the heel portion; and also includes an air-intake conduit member having an air-inlet end which is securely attached to and extended into the pocket for receiving air from outside the shoe, and also having an air-outlet end which is securely connected to the air-inlet port of the bellows; and further includes air outtake conduit members having air-inlet ends connected to the air-outlet port of the bellows with the air outtake conduit members extending throughout the bottom sole of the shoe and also having air-outlet ends extending out of a top of the bottom sole for ventilating a user's foot disposed inside the shoe.

Still yet another object of the present invention is to provide a new shoe ventilation apparatus that not only cools one's feet but also can effectively warm one's feet by drawing in warm air from a pocket warmer removably received in the pocket.

Even still another object of the present invention is to provide a new shoe ventilation apparatus that is easy and convenient to use while the user is either walking or running.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
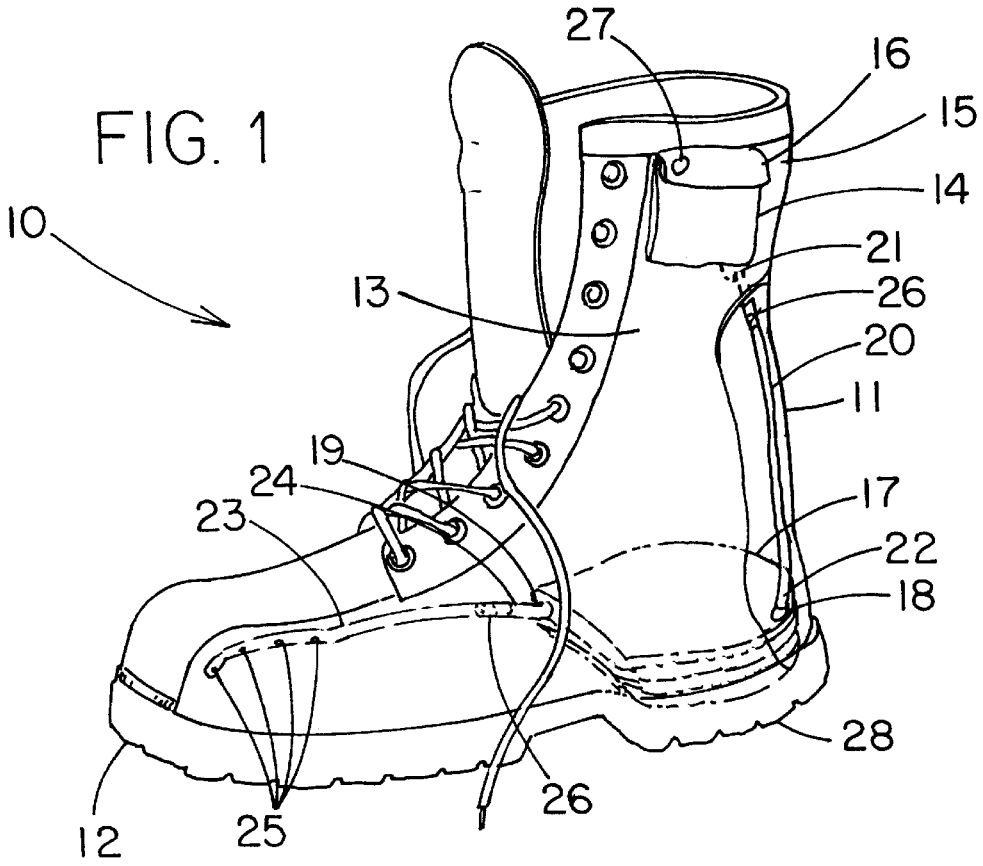
FIG. 1 is a perspective view of a new shoe ventilation apparatus according to the present invention.
Figure 2:
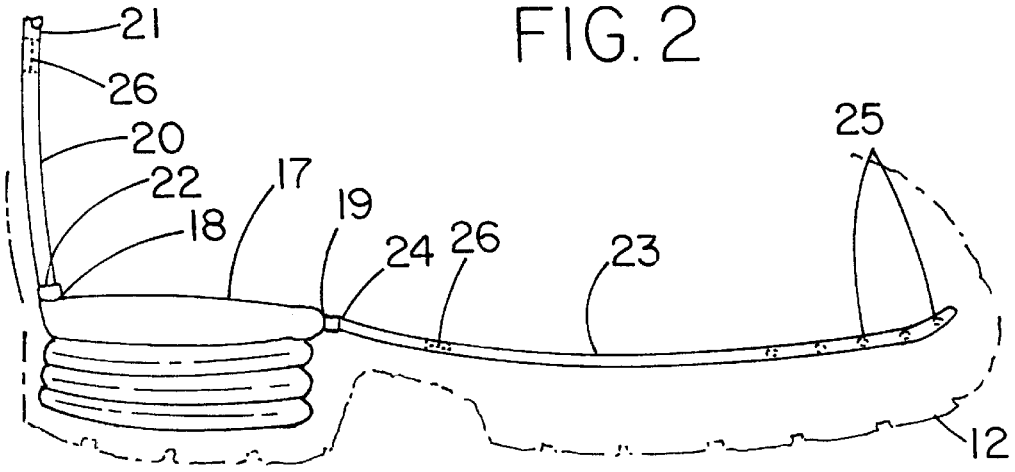
FIG. 2 is a detailed view of the conduit members and the bellows of the present invention.
Figure 3:
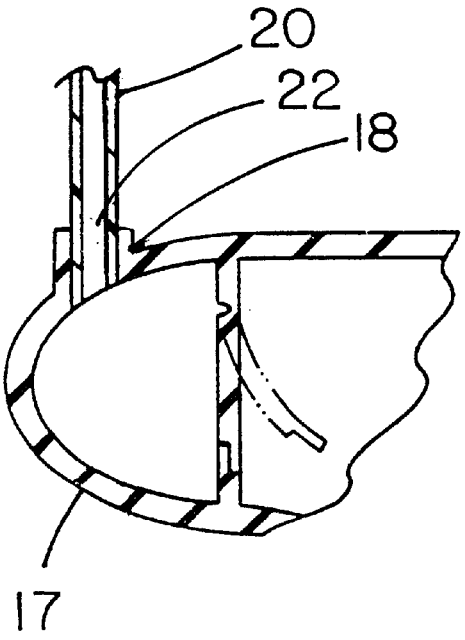
FIG. 3 is a cross-sectional view of the bellows of the present invention.
Figure 4:
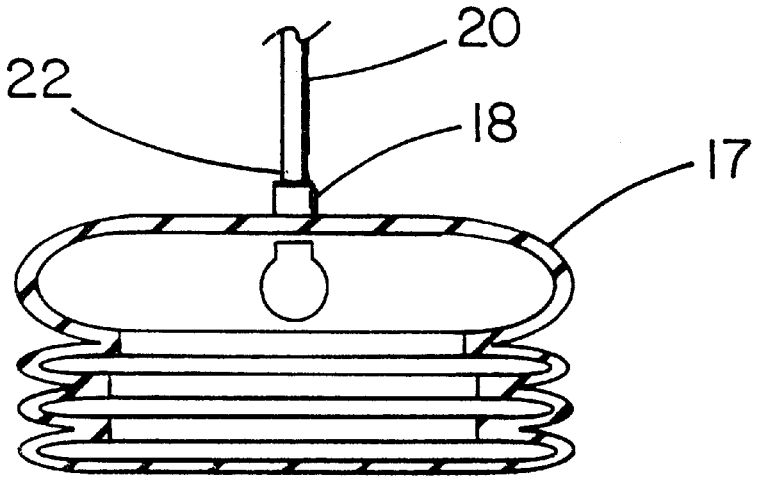
FIG. 4 is another cross-sectional view of the bellows of the present invention.

With reference now to the drawings, and in particular to FIGS. 1 through 4 thereof, a new shoe ventilation apparatus embodying the principles and concepts of the present invention and generally designated by the reference numeral 10 will be described.

As best illustrated in FIGS. 1 through 4, the shoe ventilation apparatus 10 generally comprises a shoe 11 including a bottom sole 12, a heel portion 28, and an upper portion 13. A pocket 14 is securely and conventionally attached and sewn to an exterior of the upper portion 13 of the shoe 11 near a top thereof. The pocket 14 has an open top 15 and a flap member 16 for covering the open top 15 and is adapted to receive a warming device such as a pocket warmer therein. The flap member 16 includes a wall having a plurality of openings 27 extending therethrough to allow air to enter the pocket 14. The shoe ventilation apparatus 10 also comprises a bellows 17 having an air-inlet port 18 and an air-outlet port 19 and being securely and conventionally disposed in the heel portion 28 with the bellows 17 being adapted to be depressed by a user's heel while the user is moving and wearing the shoe 11. An air-intake conduit member 20 has an air-inlet end 21 which is securely and conventionally attached to and extended into the pocket 14 for receiving air from outside the shoe 11 through. the openings 27 in the flap member 16, and also has an air-outlet end 22 which is securely and conventionally connected to the air-inlet port 18 of the bellows 17. An air outtake conduit member 23 has an air-inlet end 24 securely and conventionally connected to the air-outlet port 19 of the bellows 17 with the outtake conduit member extending throughout the bottom sole 12 of the shoe 11 and also having air-outlet ends 25 extending out of a top of the bottom sole 12 for ventilating a user's foot disposed inside the shoe 11. Valve members 26 are securely and conventionally disposed within the air-intake 20 and air outtake conduit members 23 to control flow of air therethrough with the valve members 26 being essentially one-way valve members 26 which prevent air from backing up within the conduit members 20,23.

In use, the user slips on the shoe 11 over the foot and while walking the user's heel depresses upon the bellows 17 which draws in air from the outside through the air intake conduit member 20 and forces the air through the air outtake conduit member 23 and into the foot compartment of the shoe 11. If desired during cold weather, the user can effectively warm one's feet by inserting a pocket warmer into the pocket 14 so that the bellows 17 can draw warm air into the foot compartment of the shoe 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoe ventilation apparatus comprising:

a shoe including a bottom sole, a heel portion, and an upper portion;

a pocket securely attached to an exterior of said upper portion of said shoe;

a bellows having an air-inlet port and an air-outlet port and being disposed in said heel portion;

an air-intake conduit member having an air-inlet end which is securely attached to and extended into said pocket for receiving air from outside said shoe, and also having an air-outlet end which is securely connected to said air-inlet port of said bellows;

at least one air outtake conduit members having an air-inlet end connected to said air-outlet port of said bellows with said at least one outtake conduit member extending throughout said bottom sole of said shoe and also having air-outlet ends extending out of a top of said bottom sole for ventilating a user's foot disposed inside said shoe; and a thermo-retentive device removably positioned in said interior of said pocket wherein said pocket has an open top into an interior of said pocket, and a flap member for selectively closing said open top.

2. A shoe ventilation apparatus as described in claim 1, wherein said flap member includes a wall having a plurality of openings extending therethrough to allow air to enter said pocket and said air-intake conduit member.

3. A shoe ventilation apparatus as described in claim 1, wherein said bellows is adapted to be depressed by a user's heel while the user is moving and wearing said shoe.

4. A shoe ventilation apparatus as described in claim 1, further includes valve members disposed within said air intake and air outtake conduit members to control flow of air therethrough.

5. A shoe ventilation apparatus as described in claim 4, wherein said valve members comprise one-way valve members which prevent air from backing up within said conduit members.

6. A shoe ventilation apparatus as described in claim 1, wherein said air-inlet end of said air-intake conduit member is mounted on said pocket at a lower end of said pocket, and said flap member of said pocket includes a wall having a plurality of openings extending therethrough such that air flowing through said wall of said flap member and into said air-intake conduit flows past said thermo-retentive device in said interior of said pocket.

7. A shoe ventilation apparatus as described in claim 1, wherein said thermo-retentive device comprises a pocket warmer.

8. A shoe ventilation apparatus comprising:

a shoe including a bottom sole, a heel portion, and an upper portion;

a pocket securely attached to an exterior of said upper portion of said shoe, said pocket having an open top into an interior of said pocket, and a flap member for selectively closing said open top, said interior of said pocket being adapted to receive and hold a thermo-retentive device therein;

a bellows having an air-inlet port and an air-outlet port and being disposed in said heel portion, said bellows being adapted to be depressed by a user's heel while the user is moving and wearing said shoe;

an air-intake conduit member having an air-inlet end which is securely attached to and extended into said pocket for receiving air from outside said shoe, and also having an air-outlet end which is securely connected to said air-inlet port of said bellows;

at least one air outtake conduit member having an air-inlet end connected to said air-outlet port of said bellows with said at least one outtake conduit member extending throughout said bottom sole of said shoe and also having air-outlet ends extending out of a top of said bottom sole for ventilating a user's foot disposed inside said shoe;

valve members disposed within said air-intake and air outtake conduit members to control flow of air therethrough, said valve members being essentially one-way valve members which prevent air from backing up within said conduit members; and a thermo-retentive device removably positioned in said interior of said pocket;

wherein said air-inlet end of said air-intake conduit member is mounted on said pocket at a lower end of said pocket, and said flap member of said pocket includes a wall having a plurality of openings extending therethrough such that air flowing through said wall of said flap member and into said air-intake conduit flows past said thermo-retentive device in said interior of said pocket; and wherein said thermo-retentive device comprises a pocket warmer.

* * * * *